US009101844B1

(12) United States Patent
Perri

(10) Patent No.: US 9,101,844 B1
(45) Date of Patent: Aug. 11, 2015

(54) AROUND THE WORLD ROTARY TOY SYSTEM

(71) Applicant: Isabel Perri, Stamford, CT (US)

(72) Inventor: Isabel Perri, Stamford, CT (US)

( * ) Notice: Subject to any disclaimer, the term of this patent is extended or adjusted under 35 U.S.C. 154(b) by 0 days.

(21) Appl. No.: 14/337,094

(22) Filed: Jul. 21, 2014

Related U.S. Application Data

(60) Provisional application No. 61/875,604, filed on Sep. 9, 2013.

(51) Int. Cl.
*A63G 1/16* (2006.01)
*A63B 22/00* (2006.01)

(52) U.S. Cl.
CPC ..... *A63G 1/16* (2013.01)

(58) Field of Classification Search
CPC ..... A63G 1/00; A63G 1/12; A63G 1/16; A63B 22/00; A63B 22/14; A63B 22/18
USPC ..... 472/14, 19, 20, 136, 137; 446/69, 227, 446/236
See application file for complete search history.

(56) References Cited

U.S. PATENT DOCUMENTS

| | | | | |
|---|---|---|---|---|
| 2,506,214 | A * | 5/1950 | Harman | 472/19 |
| 3,170,687 | A * | 2/1965 | Lugger | 472/19 |
| 3,873,087 | A | 3/1975 | Burkart et al. | |
| 5,118,094 | A | 6/1992 | Lambert | |
| 5,795,235 | A | 8/1998 | Ullrich et al. | |
| 6,342,013 | B1 * | 1/2002 | Irelan | 472/14 |
| 8,348,775 | B1 * | 1/2013 | Morgan | 472/19 |

* cited by examiner

*Primary Examiner* — Kien Nguyen
(74) *Attorney, Agent, or Firm* — RG Patent Consulting, LLC; Rachel Gilboy

(57) ABSTRACT

An activity toy having a rotating platform on which a child (ages 6 and up) can sit, with the platform maneuvered about a central axis by way of a sturdy, circular shaped steering mechanism mounted to a support post that runs vertically from the center of the unit to provide children, particularly older children, teens and adults with special needs the ability to enjoy hours of fun.

19 Claims, 5 Drawing Sheets

AROUND THE WORLD ROTARY TOY SYSTEM

CROSS-REFERENCE TO RELATED APPLICATION

The present application is related to and claims priority from prior provisional application Ser. No. 61/875,604, filed Sep. 9, 2013 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

The following includes information that may be useful in understanding the present invention(s). It is not an admission that any of the information provided herein is prior art, or material, to the presently described or claimed inventions, or that any publication or document that is specifically or implicitly referenced is prior art.

BACKGROUND OF THE INVENTION

1. Field of the Invention

The present invention relates generally to the field of rotary self-propelled amusement devices and more specifically relates to an around the world rotary toy system.

2. Description of the Related Art

Every year, over 10,000 children and teens in the United States are diagnosed with a mental or physical disability ranging in degree of severity from mild asthma, attention deficit disorder, diabetes, obesity, mental retardation, spina bifida and cerebral palsy. Living with a disability can greatly affect a person's ability to function freely in society. While determination is a key factor in anyone's success, children and teens with limited mobility must overcome daily obstacles that most able bodied persons often take for granted. Activities such as showering, getting dressed and even playing with friends can be extremely difficult for a child with limited mobility, especially for those with limited use of their hands.

For children with special needs, the simple act of playing with favorite toys can be a challenge, especially as the child has physically grown out of a particular toy or activity even though the toy is age appropriate for the child due to diminished mental capacity. However, most children outgrow toys and are able to move on to other more complicated or challenging physical activities, many children with physical or mental challenges are not able to move on. Older children may have physically outgrown their toys and are not able to use them because the toy isn't large enough or sturdy enough to support their size and weight.

Various attempts have been made to solve the above-mentioned problems such as those found in U.S. Pat. No. 5,118,094 to Gregory F. Lambert, U.S. Pat. No. 3,873,087 to Jacob W. Burkart, et al, U.S. Pat. No. 5,795,235 to Jurgen Ullrich et al. This art is representative of rotary self-propelled amusement devices. None of the above inventions and patents, taken either singly or in combination, is seen to describe the invention as claimed.

Ideally, an around the world rotary toy system should provide safe physical activity and fun for children with physical or mental limitations as they grow larger in size and, yet would operate reliably and be manufactured at a modest expense. Thus, a need exists for a reliable around the world rotary toy system to avoid the above-mentioned problems.

BRIEF SUMMARY OF THE INVENTION

In view of the foregoing disadvantages inherent in the known rotary self-propelled amusement devices art, the present invention provides a novel around the world rotary toy system. The general purpose of the present invention, which will be described subsequently in greater detail is to provide physical and fun activity for children with physical or mental limitations as they grow larger in size.

An around the world rotary toy system is disclosed herein, in a preferred embodiment, comprising: a rotary-toy-system-assembly comprising in functional combination a generally-circular-stationary-base having a base-upper-surface, a base-bottom-surface and a base-side-surface, a vertical-cylindrical-support-post having a top-section and a bottom-section, the bottom-section having a rim, a generally-circular-handgrip having a handgrip-top-surface and a handgrip-bottom-surface, and a generally-circular-rotating-seat-platform having a platform-top-side, a platform-side and a platform-bottom-opening.

The rotary-toy-system-assembly is structured and arranged to support the size and weight of a user comprising a grown child. The vertical-cylindrical-support-post, generally-circular-handgrip, and generally-circular-rotating-seat-platform comprise heavy duty polished wooden material to provide a smooth splinter-free surface for the user. The handgrip-top-surface, vertical-cylindrical-support-post, and generally-circular-rotating-seat-platform comprises bright colors and functional indicia to the attract attention of users and to induce learning in the user.

The generally-circular-stationary-base measures approximately 32 inches in diameter to provide a solid foundation for the rotary-toy-system-assembly having an overall height of approximately 17 inches when prepared for use. The generally-circular-stationary-base comprises heavy duty wooden material of sufficient weight and strength so as to be able to resist deformation and tipping while in use. The base-bottom-surface is structured and arranged to rest on a planar surface comprising a floor surface providing stability for the rotary-toy-system-assembly when in use. The base-bottom-surface of the generally-circular-stationary-base comprises a flat surface able to securely rest on the floor.

The bottom-section of the vertical-cylindrical-support-post comprising a volume is fixedly attached to the base-upper-surface via a plurality of wood screw fasteners extending through the rim into the base-upper-surface such that the vertical-cylindrical-support-post is non-rotatable with respect to the generally-circular-stationary-base when in use. The rim comprises a hollow circular shape of heavy duty polished wooden material having a depth of approximately one inch secured to a lower portion of the bottom-section via wood glue and a plurality of wood screw fasteners, and extends out from the bottom-section of the vertical-cylindrical-support-post approximately three inches allowing the generally-circular-rotating-seat-platform to rest on the rim and be able to be spun by the user as desired.

The top-section of the vertical-cylindrical-support-post preferably comprises a solid piece of wood having a diameter able to collapse into the volume of the bottom-section when not in use. The top-section of the vertical-cylindrical-support-post is fixedly attached to the handgrip-bottom-surface via wood screw fasteners extending down through the generally-circular-handgrip and into a top-portion of the top-section of the vertical-cylindrical-support-post. The top-section of the vertical-cylindrical-support-post is fixedly attached to the handgrip-bottom-surface and is able to be collapsed into the volume of the bottom-section when the rotary-toy-system-assembly is not in use.

The top-section and the bottom-section each may comprise an attachment means. One attachment means comprising two retractable push-buttons is located toward the bottom of the top-section. Each of the push-buttons is located opposite each other on the side of the top-section. A second attachment means comprising two holes is located toward the top of the bottom-section, each of the holes located on opposite sides of the bottom-section. The top-section is able to be removably coupled to the bottom-section via the connection means having the push-buttons on the top-section removably inserted into the holes on the bottom-section when the around the world rotary toy system is in use. The top-section comprises a top-surface which is fixedly attached to the hand-grip-bottom-surface.

The generally-circular-rotating-seat-platform comprises a center-hole allowing the bottom-section to fit upward through the generally-circular-rotating-seat-platform via the center-hole allowing the generally-circular-rotating-seat-platform to rest on the rim of the bottom-section. The rim is located adjacent to the bottom-surface of the bottom-section.

The generally-circular-handgrip having a handgrip-top-surface and a handgrip-bottom-surface is able to be gripped by the hands of the user when in use. The handgrip-top-surface of the generally-circular-handgrip comprises a lighted go-right-light, a lighted go-left-light and a lighted-stop-light. The lighted go-right-light and the lighted go-left-light are activated by maneuvering of the generally-circular-handgrip by the user. The lighted-stop-light is activated when the generally-circular-handgrip is not being maneuvered by the user. Each of these lights is powered by batteries located in a plurality of cutouts on the generally-circular-handgrip.

The user is able to sit upon the generally-circular-rotating-seat-platform with legs wrapped around the vertical-cylindrical-support-post and use hands to grip the generally-circular-handgrip in a manner able to maneuver the generally-circular-rotating-seat-platform by rotating the generally-circular-handgrip in a left-direction and a right-direction as desired thus generating movement in a manner to provide entertainment and amusement for the user.

The present invention holds significant improvements and serves as an around the world rotary toy system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, around the world rotary toy system, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a rotary self-propelled amusement device and more particularly to an around the world rotary toy system as used to provide physical activity and fun for children with physical or mental limitations as they grow larger in size.

Generally speaking, the around the world rotary toy system is a toy to accommodate larger children and/or adults who have physical or mental limitations. The around the world rotary toy system is a self-propelled spinning toy with a rotating platform serving as a seat for the user and a hand-operated circular control mechanism joined to the platform via a support post the user is able to manipulate to adjust speed and direction of the spin.

Figure 1:
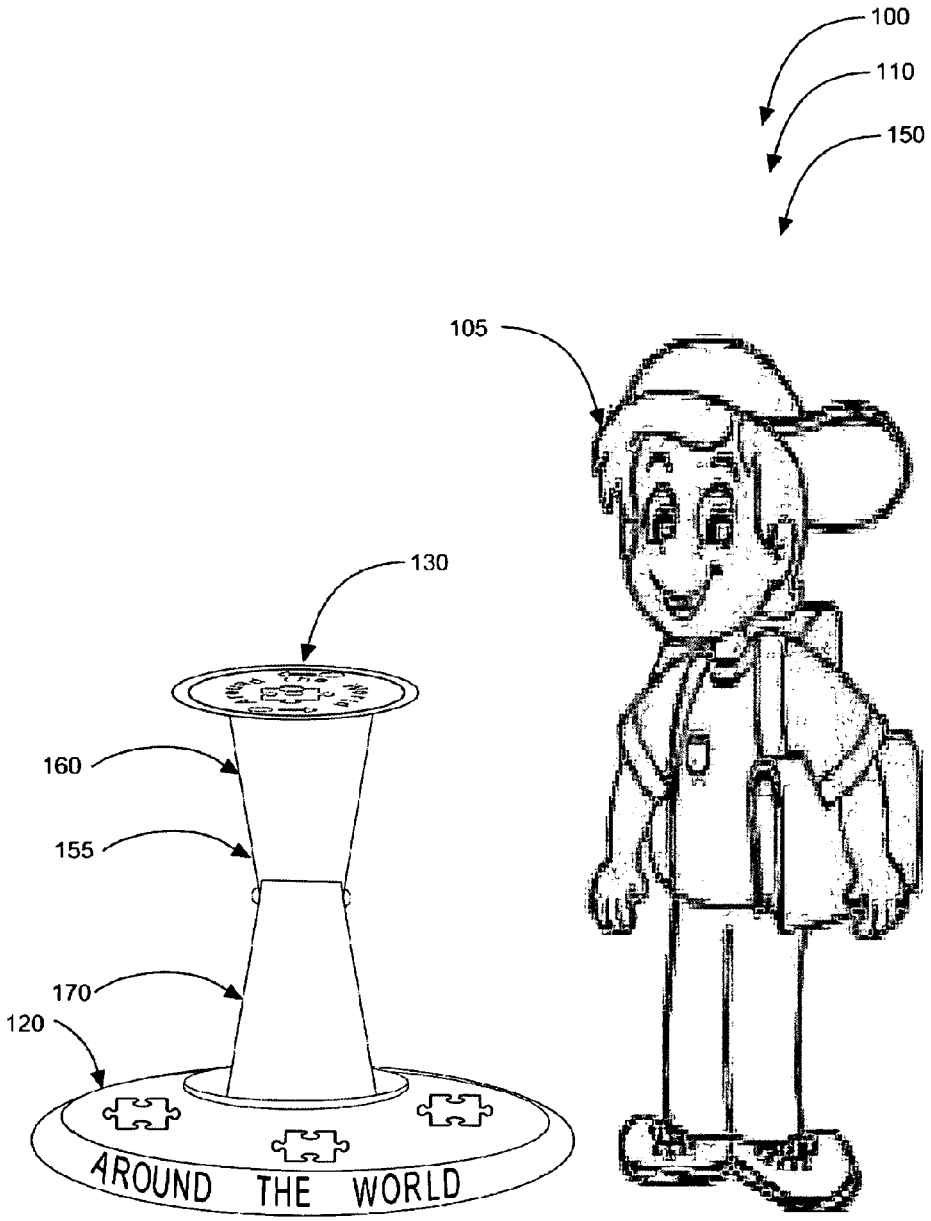
FIG. 1 shows a perspective view illustrating an around the world rotary toy system in an in-use condition according to an embodiment of the present invention.

Referring to the drawings by numerals of reference there is shown in FIG. 1, a perspective view illustrating around the world rotary toy system 100 in an in-use condition 150 according to an embodiment of the present invention.

Around the world rotary toy system 100 comprises rotary-toy-system-assembly 110 comprising in functional combination generally-circular-stationary-base 120 having base-upper-surface 123, base-bottom-surface 126 and base-side-surface 129, vertical-cylindrical-support-post 155 having top-section 160 and bottom-section 170, bottom-section 170 having rim 180, generally-circular-handgrip 130 having handgrip-top-surface 132 and handgrip-bottom-surface 134, and generally-circular-rotating-seat-platform 140 having platform-top-side 142, platform-side 144 and platform-bottom-opening 146.

User 105 is able to sit upon generally-circular-rotating-seat-platform 140 with his/her legs wrapped around vertical-cylindrical-support-post 155 and using his/her hands to grip generally-circular-handgrip 130 in a manner able to maneuver generally-circular-rotating-seat-platform 140 by rotating generally-circular-handgrip 130 in a left-direction and a right-direction as desired, thus generating movement in a manner to provide entertainment and amusement for user 105.

Figure 2:
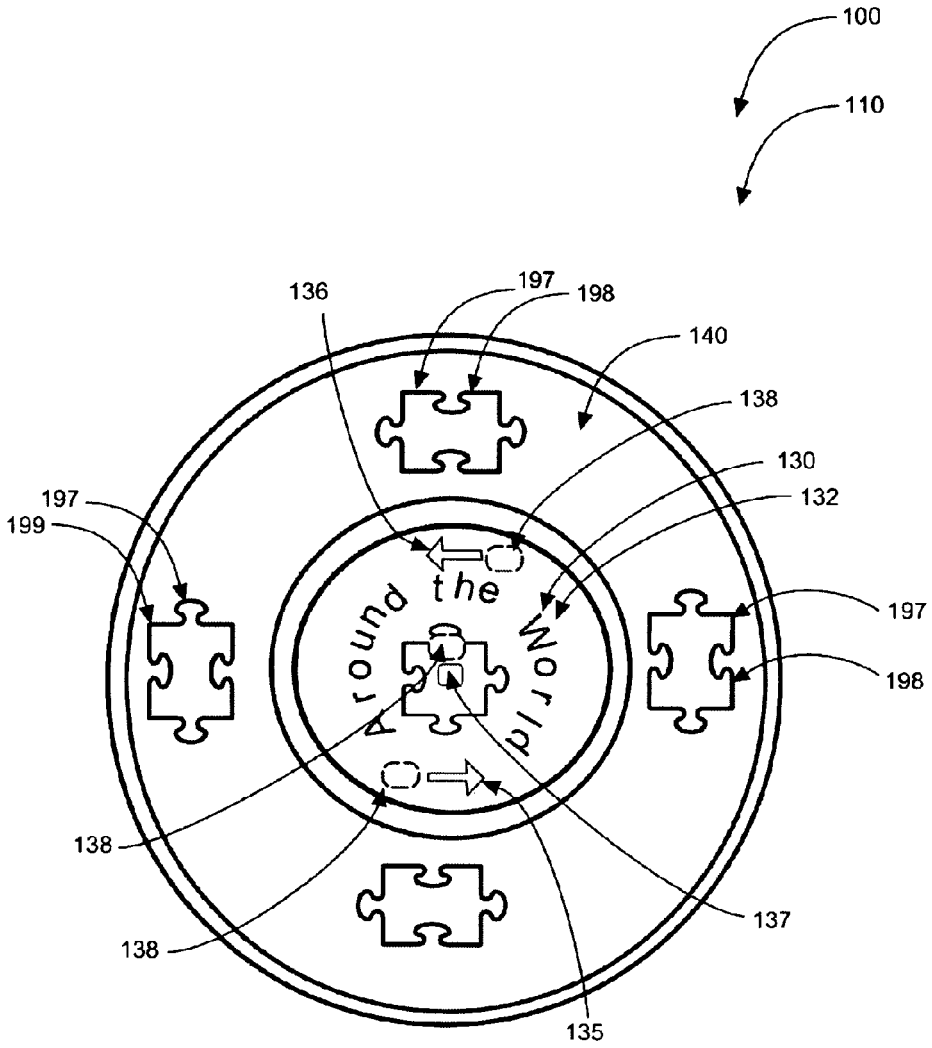
FIG. 2 is a perspective view illustrating a top view of an around the world rotary toy system according to an embodiment of the present invention of FIG. 1.

Referring now to FIG. 2, a perspective view illustrating a top view of around the world rotary toy system 100 according to an embodiment of the present invention of FIG. 1.

Rotary-toy-system-assembly 110 is structured and arranged to support the size and weight of user 105 comprising a grown child. Rotary-toy-system-assembly 110 may also be used by some adults having special needs desiring to have a fun activity. Vertical-cylindrical-support-post 155, generally-circular-handgrip 130, and generally-circular-rotating-seat-platform 140 comprise heavy duty polished wooden material to provide a smooth splinter-free surface for user 105.

In alternate embodiments, vertical-cylindrical-support-post 155, generally-circular-handgrip 130, and generally-circular-rotating-seat-platform 140 comprise heavy duty plastic material and other suitable materials to provide a smooth splinter-free surface for user 105. Handgrip-top-surface 132, vertical-cylindrical-support-post 155, and generally-circular-rotating-seat-platform 140 comprises bright colors and functional indicia to the attract attention of users 105 and to induce learning in user 105. Generally-circular-handgrip 130 and generally-circular-rotating-seat-platform 140 comprise indicia 197 comprising puzzle pieces 198. In alternate embodiments, generally-circular-handgrip 130 and generally-circular-rotating-seat-platform 140 comprise indicia 197 comprising novelty décor which may include animal figures, super-hero characters and other suitable indicia to attract the attention of user 105. Handgrip-top-surface comprises indicia 197 compromising the phrase around the world 199.

Generally-circular-stationary-base 120 measures approximately 32 inches in diameter to provide a solid foundation for rotary-toy-system-assembly 110 having an overall height of approximately 17 inches when prepared for use. Smaller and larger dimensions may also be used to accommodate the size of user 105. Generally-circular-stationary-base 120 comprises heavy duty wooden material of sufficient weight and strength so as to be able to resist deformation and tipping while in use. In other embodiments generally-circular-stationary-base 120 comprises heavy duty plastic material and other suitable materials of sufficient weight and strength so as to be able to resist deformation and tipping while in use. Base-bottom-surface 126 is structured and arranged to rest on a planar surface comprising a floor surface providing stability for rotary-toy-system-assembly 110 when in use. Base-bottom-surface 126 of generally-circular-stationary-base 120 comprises a flat surface able to securely rest on the floor.

Figure 3:
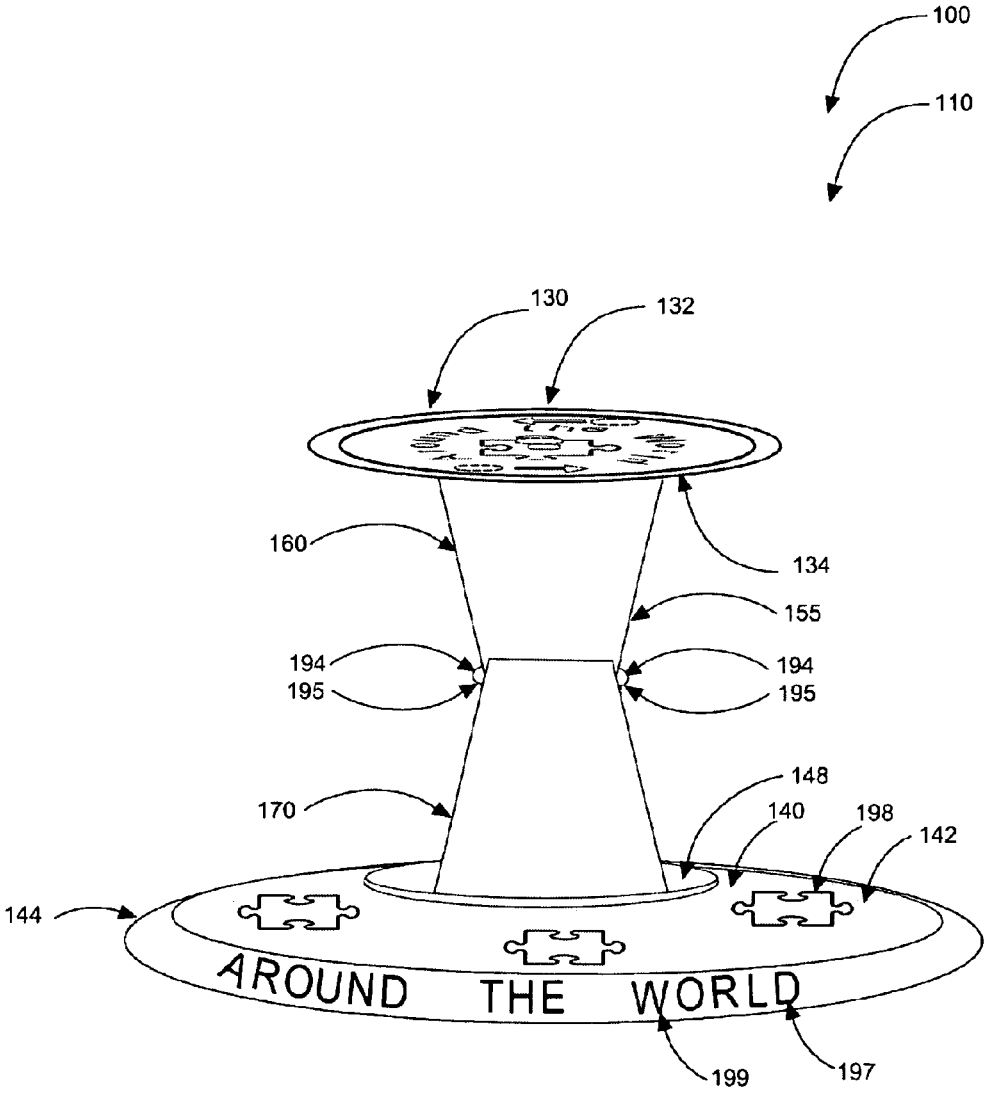
FIG. 3 is a perspective view illustrating a side view of the around the world rotary toy system according to an embodiment of the present invention of FIG. 1.

Referring now to FIG. 3, a perspective view illustrating a side view of around the world rotary toy system 100 according to an embodiment of the present invention of FIG. 1.

Bottom-section 170 of vertical-cylindrical-support-post 155 comprising volume 172 is fixedly attached to base-upper-surface 123 via a plurality of wood screw fasteners (or the like) extending through rim 180 into base-upper-surface 123 such that vertical-cylindrical-support-post 155 is non-rotatable with respect to generally-circular-stationary-base 120 when in use. Rim 180 comprises a hollow circular shape of heavy duty polished wooden material having a depth of approximately one inch secured to lower portion 174 of bottom-section 170 via wood glue and plurality of wood screw fasteners, and extends out from bottom-section 170 of vertical-cylindrical-support-post 155 approximately three inches allowing generally-circular-rotating-seat-platform 140 to rest on rim 180 and be able to be spun by user 105 as desired. Other suitably equivalent materials and fastening means may be used.

Figure 4:
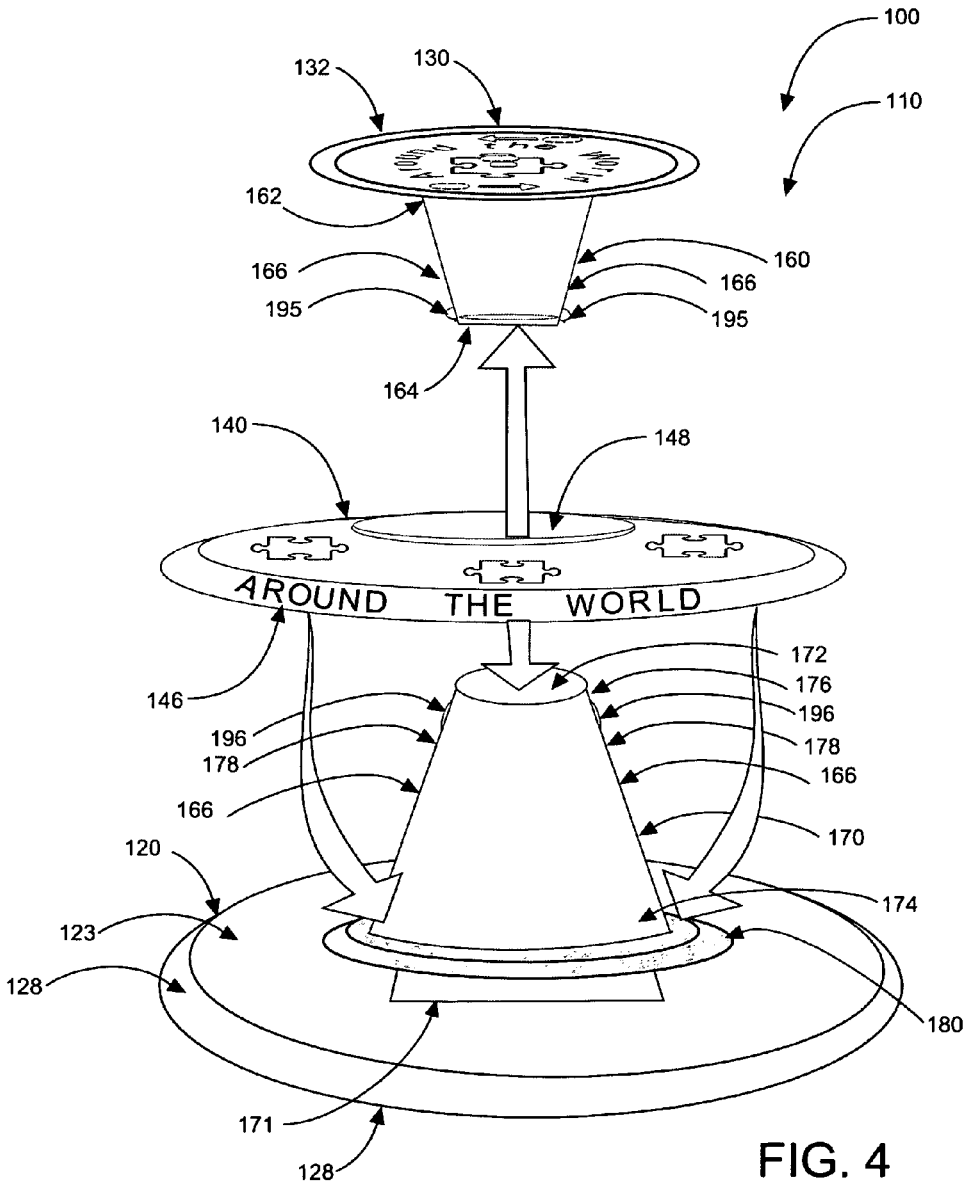
FIG. 4 is a perspective view illustrating components of the around the world rotary toy system according to an embodiment of the present invention of FIG. 1.

Referring now to FIG. 4, a perspective view illustrating components of around the world rotary toy system 100 according to an embodiment of the present invention of FIG. 1.

Top-section 160 of vertical-cylindrical-support-post 155 preferably comprises a solid piece of wood having a diameter able to collapse into volume 172 of bottom-section 170 when not in use. Top-section 160 of vertical-cylindrical-support-post 155 is fixedly attached to handgrip-bottom-surface 134 via wood screw fasteners extending down through generally-circular-handgrip 130 and into top-portion 162 of top-section 160 of vertical-cylindrical-support-post 155. Top-section 160 of vertical-cylindrical-support-post 155 is fixedly attached to handgrip-bottom-surface 134 and is able to be collapsed into volume 172 of bottom-section 170 when rotary-toy-system-assembly 110 is not in use.

Top-section 160 and bottom-section 170 each comprise attachment means 194. One attachment means 194 comprising two retractable push-buttons 195 located toward bottom 164 of top-section 160. Each of push-buttons 195 is located opposite each other on side 166 of top-section 160. A second attachment means 194 comprising two holes 196 is located toward top 176 of bottom-section 170, each of holes 196 located on opposite sides 178 of bottom-section 170. Top-section 160 is able to be removably coupled to bottom-section 170 via connection means 194 having push-buttons 195 on top-section 160 removably inserted into holes 196 on bottom-section 170 when around the world rotary toy system 100 is in use. Top-section 160 comprises top-surface 168 which is fixedly attached to hand-grip-bottom-surface 134.

Generally-circular-rotating-seat-platform 140 comprises center-hole 148 allowing bottom-section 170 to fit upward through generally-circular-rotating-seat-platform 140 via center-hole 148 allowing generally-circular-rotating-seat-platform 140 to rest on rim 180 of bottom-section 170. Rim 180 is located adjacent to bottom-surface 171 of bottom-section 170.

Generally-circular-handgrip 130 having handgrip-top-surface 132 and handgrip-bottom-surface 134 is able to be gripped by the hands of user 105 when in use. Handgrip-top-surface 132 of generally-circular-handgrip 130 comprises lighted go-right-light 135, lighted go-left-light 136 and lighted-stop-light 137. Lighted go-right-light 135 and lighted go-left-light 136 are activated by maneuvering of generally-circular-handgrip 130 by user 105. Lighted-stop-light 137 is activated when generally-circular-handgrip 130 is not being maneuvered by user 105. Each of these lights is powered by batteries located in plurality of cutouts 138 on generally-circular-handgrip 130.

Around the world rotary toy system 100 may be sold as a kit comprising the following parts: at least one generally-circular-stationary-base 120 having base-upper-surface 123, base-bottom-surface 126 and base-side-surface 128 at least one vertical-cylindrical-support-post 155 having top-section 160 and bottom-section 170; at least one generally-circular-handgrip 130 having handgrip-top-surface 132 and handgrip-bottom-surface 134; at least one generally-circular-rotating-seat-platform 140 having platform-top-side 142, platform-side 144 and platform-bottom-opening 146; and at least one set of user instructions. The kit has instructions such that functional relationships are detailed in relation to the structure of the invention (such that the invention can be used, maintained, or the like in a preferred manner). Around the world rotary toy system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

Figure 5:
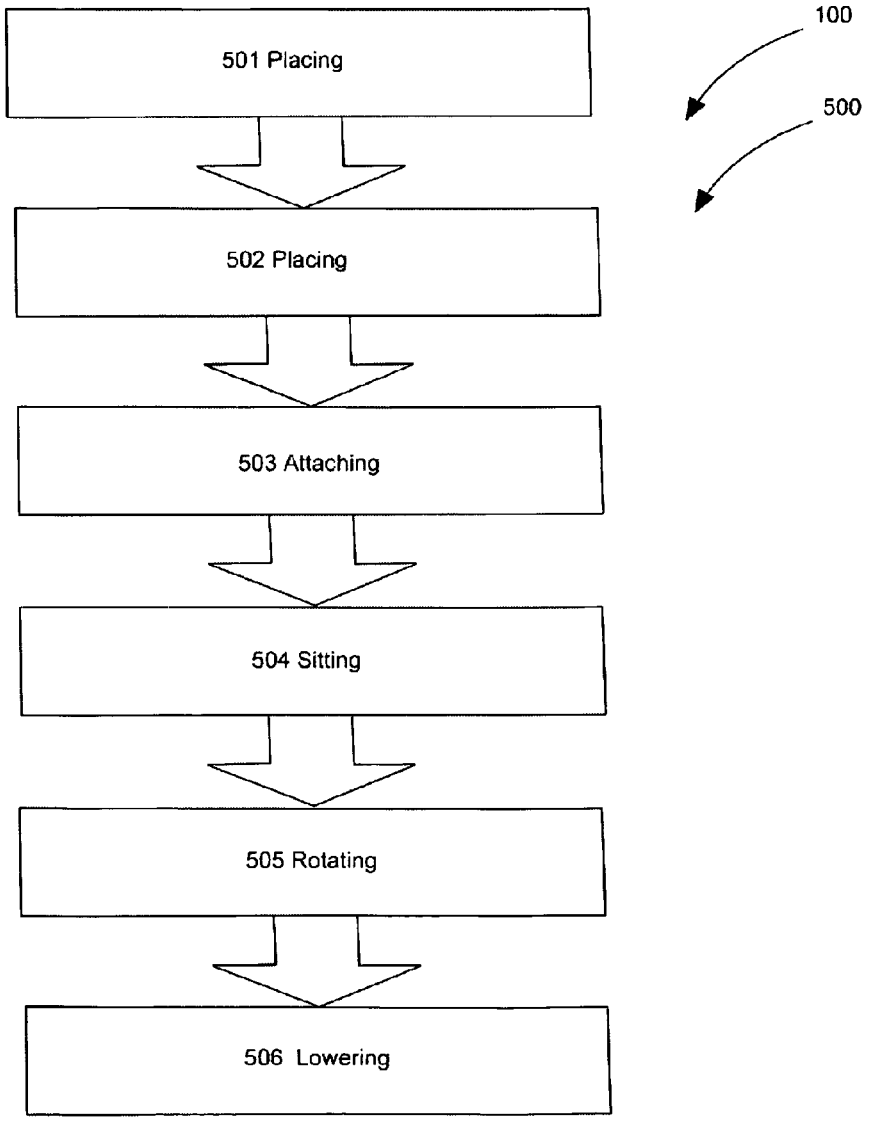
FIG. 5 is a flowchart illustrating a method of use for the around the world rotary toy system according to an embodiment of the present invention of FIGS. 1-4.

Referring now to FIG. 5, a flowchart illustrating a method of use 500 for around the world rotary toy system 100 according to an embodiment of the present invention of FIGS. 1-4.

A method of use 500 for around the world rotary toy system 100 may comprise the steps of: step one 501 placing generally-circular-stationary-base 120 with attached bottom-section 170 of vertical-cylindrical-support-post 155 on a planar surface for use; step two 502 placing generally-circular-rotating-seat-platform 140 on rim 180 of bottom-section 170; step three 503 attaching top-section 160 of vertical-cylindrical-support-post 155 to bottom-section 170 of vertical-cylindrical-support-post 155 via attachment means 194; step four 504 sitting on generally-circular-rotating-seat-platform 140; step five 505 rotating generally-circular-rotating-seat-platform 140 via using their hands to maneuver generally-circular-handgrip 130 as desired; and step six 506 lowering top-section 160 into volume 172 of bottom-section 170 via releasing attachment-means 194 for storage when not in use.

It should be noted that the steps described in the method of use can be carried out in many different orders according to user preference. The use of "step of" should not be interpreted as "step for", in the claims herein and is not intended to invoke the provisions of 35 U.S.C. §112, ¶ 6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. An around the world rotary toy system comprising:

a rotary-toy-system-assembly comprising;

a generally-circular-stationary-base having a base-upper-surface, a base-bottom-surface and a base-side-surface;

a vertical-cylindrical-support-post having a top-section and a bottom-section, said bottom-section having a rim;

a generally-circular-handgrip having a handgrip-top-surface and a handgrip-bottom-surface; and a generally-circular-rotating-seat-platform having a platform-top-side, a platform-side and a platform-bottom-opening;

wherein said around the world rotary toy system comprises said rotary-toy-system-assembly comprising in functional combination said generally-circular-stationary-base having said base-upper-surface, said base-bottom-surface and said base-side-surface, said vertical-cylindrical-support-post having said top-section and said bottom-section, said bottom-section having said rim, said generally-circular-handgrip having said handgrip-top-surface and said handgrip-bottom-surface, and said generally-circular-rotating-seat-platform having said platform-top-side, said platform-side and said platform-bottom-opening;

wherein said base-bottom-surface is structured and arranged to rest on a planar surface providing stability for said rotary-toy-system-assembly when in use;

wherein said bottom-section having said rim of said vertical-cylindrical-support-post comprises a volume and is fixedly attached to said base-upper-surface via said rim such that said vertical-cylindrical-support-post is non-rotatable with respect to said generally-circular-stationary-base;

wherein said top-section of said vertical-cylindrical-support-post is fixedly attached to said handgrip-bottom-surface and is able to be collapsed into said volume of said bottom-section when said rotary-toy-system-assembly is not in use;

wherein said top-section and said bottom-section each comprise an attachment means, said attachment means located toward a bottom of said top-section and toward a top of said bottom-section allowing said top-section to be removably coupled to said bottom-section when in use;

wherein said top-section comprises a top-surface fixedly attached to said hand-grip-bottom-surface;

wherein said rim of said bottom-section is fixedly attached to said base-upper-surface;

wherein said generally-circular-rotating-seat-platform comprises a center-hole allowing said bottom-section to fit upward through said generally-circular-rotating-seat-platform, said generally-circular-rotating-seat-platform to rest on said rim of said bottom-section, said rim located adjacent to said bottom-surface of said bottom-section;

wherein said generally-circular-handgrip having said handgrip-top-surface and said handgrip-bottom-surface is able to be gripped by hands of said user when in use; and wherein said user is able to sit upon said generally-circular-rotating-seat-platform and use hands to grip said generally-circular-handgrip in a manner able to rotatably maneuver said generally-circular-rotating-seat-platform by rotating said generally-circular-handgrip in a left-direction and a right-direction as desired thus generating movement in a manner to provide entertainment for said user.

2. The around the world rotary toy system of claim 1 wherein said rotary-toy-system-assembly is structured and arranged to support a size and weight of said user comprising a grown child.

3. The around the world rotary toy system of claim 2 wherein said vertical-cylindrical-support-post, said generally-circular-handgrip, and said generally-circular-rotating-seat-platform comprise heavy duty polished wooden material to provide a smooth splinter-free surface for said user.

4. The around the world rotary toy system of claim 3 wherein said generally-circular-stationary-base measures approximately 32 inches in diameter to provide a solid foundation for said rotary-toy-system-assembly and said user when in use.

5. The around the world rotary toy system of claim 4 wherein said generally-circular-stationary-base comprises heavy duty wooden material of sufficient weight and strength so as to be able to resist deformation and tipping while in use.

6. The around the world rotary toy system of claim 5 wherein said base-bottom-surface of said generally-circular-stationary-base comprises a flat surface able to securely rest on said planar-surface comprising a floor.

7. The around the world rotary toy system of claim 1 wherein said rim comprises a hollow circular shape of said heavy duty polished wooden material structured and arranged to be fixedly secured to a lower portion of said bottom-section via wood glue and wood screw fasteners.

8. The around the world rotary toy system of claim 7 wherein said rim extends out from said bottom-section of said vertical-cylindrical-support-post approximately three inches allowing said generally-circular-rotating-seat-platform to rest on said rim, said generally-circular-rotating-seat-platform able to be spun by said user as desired.

9. The around the world rotary toy system of claim 7 wherein said top-section of said vertical-cylindrical-support-post comprises a solid piece of wood having a diameter able to collapse into said volume of said bottom-section when not in use.

10. The around the world rotary toy system of claim 9 wherein said top-section of said vertical-cylindrical-support-post is fixedly attached to said handgrip-bottom-surface via said wood screw fasteners extending down through said generally-circular-handgrip and into a top-portion of said top-section of said vertical-cylindrical-support-post.

11. The around the world rotary toy system of claim 10 wherein said attachment means located toward said bottom of said top-section comprises two retractable push-buttons located toward bottom of said top-section, each of said push-buttons located opposite each other on said side of said top-section.

12. The around the world rotary toy system of claim 1 wherein said bottom-section of said vertical-cylindrical-support-post is fixedly attached to said base-upper-surface via said wood screw fasteners extending through said rim having a depth of approximately one inch into said base-upper-surface.

13. The around the world rotary toy system of claim 1 wherein said attachment means located toward said top of said bottom-section comprise two holes, each of said holes located opposite each other on said side of said bottom-section able to receive and hold in place each of said retractable push-buttons providing a coupling of said top-section and said-bottom-section when said rotary-toy-system-assembly is in use.

14. The around the world rotary toy system of claim 1 wherein said handgrip-top-surface, said vertical-cylindrical-support-post, and said generally-circular-rotating-seat-platform comprises bright colors and functional indicia to attract attention of said users and to induce learning in said user.

15. The around the world rotary toy system of claim 14 wherein said handgrip-top-surface of said generally-circular-handgrip comprising a lighted go-right-light, a lighted go-left-light and a lighted-stop-light.

16. The around the world rotary toy system of claim 15 wherein said lighted go-right-light and said lighted go-left-light are activated by maneuvering of said generally-circular-handgrip by said user, said lighted-stop-light activated when said generally-circular-handgrip is not being maneuvered by said user.

17. The around the world rotary toy system of claim 16 wherein said lighted go-right-light, said lighted go-left-light, and said lighted-stop-light, each are powered by batteries located in a plurality of cutouts on generally-circular-handgrip.

18. An around the world rotary toy system comprising:

a rotary-toy-system-assembly comprising;

a generally-circular-stationary-base having a base-upper-surface, a base-bottom-surface and a base-side-surface;

a vertical-cylindrical-support-post having a top-section and a bottom-section, said bottom-section having a rim;

a generally-circular-handgrip having a handgrip-top-surface and a handgrip-bottom-surface; and a generally-circular-rotating-seat-platform having a platform-top-side, a platform-side and a platform-bottom-opening;

wherein said around the world rotary toy system comprises said rotary-toy-system-assembly comprising in functional combination said generally-circular-stationary-base having said base-upper-surface, said base-bottom-surface and said base-side-surface, said vertical-cylindrical-support-post having said top-section and said bottom-section, said bottom-section having said rim, said generally-circular-handgrip having said handgrip-top-surface and said handgrip-bottom-surface, and said generally-circular-rotating-seat-platform having said platform-top-side, said platform-side and said platform-bottom-opening;

wherein said rotary-toy-system-assembly is structured and arranged to support a size and weight of said user comprising a grown child;

wherein said vertical-cylindrical-support-post, said generally-circular-handgrip, and said generally-circular-rotating-seat-platform comprise heavy duty polished wooden material to provide a smooth splinter-free surface for said user;

wherein said generally-circular-stationary-base measures approximately 32 inches in diameter to provide a solid foundation for said rotary-toy-system-assembly and said user when in use;

wherein said generally-circular-stationary-base comprises heavy duty wooden material of sufficient weight and strength so as to be able to resist deformation and tipping while in use;

wherein said base-bottom-surface is structured and arranged to rest on a planar surface providing stability for said rotary-toy-system-assembly when in use;

wherein said base-bottom-surface of said generally-circular-stationary-base comprises a flat surface able to securely rest on said planar-surface comprising a floor;

wherein said bottom-section of said vertical-cylindrical-support-post is fixedly attached to said base-upper-surface via said wood screw fasteners extending through said rim having a depth of approximately one inch into said base-upper-surface;

wherein said bottom-section having said rim of said vertical-cylindrical-support-post comprises a volume and is fixedly attached to said base-upper-surface via said rim such that said vertical-cylindrical-support-post is non-rotatable with respect to said generally-circular-stationary-base;

wherein said rim comprises a hollow circular shape of said heavy duty polished wooden material structured and arranged to be fixedly secured to a lower portion of said bottom-section via wood glue and wood screw fasteners;

wherein said rim extends out from said bottom-section of said vertical-cylindrical-support-post approximately three inches allowing said generally-circular-rotating-seat-platform to rest on said rim, said generally-circular-rotating-seat-platform able to be spun by said user as desired;

wherein said top-section of said vertical-cylindrical-support-post comprises a solid piece of wood having a diameter able to collapse into said volume of said bottom-section when not in use;

wherein said top-section of said vertical-cylindrical-support-post is fixedly attached to said handgrip-bottom-surface via said wood screw fasteners extending down through said generally-circular-handgrip and into a top-portion of said top-section of said vertical-cylindrical-support-post;

wherein said top-section of said vertical-cylindrical-support-post is fixedly attached to said handgrip-bottom-surface and is able to be collapsed into said volume of said bottom-section when said rotary-toy-system-assembly is not in use;

wherein said top-section and said bottom-section each comprise an attachment means, said attachment means located toward a bottom of said top-section and toward a top of said bottom-section allowing said top-section to be removably coupled to said bottom-section when in use;

wherein said attachment means located toward said bottom of said top-section comprises two retractable push-buttons located toward bottom of said top-section, each of said push-buttons located opposite each other on said side of said top-section;

wherein said attachment means located toward said top of said bottom-section comprise two holes, each of said holes located opposite each other on said side of said bottom-section able to receive and hold in place each of said retractable push-buttons providing a coupling of said top-section and said-bottom-section when said rotary-toy-system-assembly is in use;

wherein said top-section comprises a top-surface fixedly attached to said hand-grip-bottom-surface;

wherein said rim of said bottom-section is fixedly attached to said base-upper-surface;

wherein said generally-circular-rotating-seat-platform comprises a center-hole allowing said bottom-section to fit upward through said generally-circular-rotating-seat-platform, said generally-circular-rotating-seat-platform to rest on said rim of said bottom-section, said rim located adjacent to said bottom-surface of said bottom-section;

wherein said generally-circular-handgrip having said handgrip-top-surface and said handgrip-bottom-surface is able to be gripped by hands of said user when in use;

wherein said handgrip-top-surface, said vertical-cylindrical-support-post, and said generally-circular-rotating-seat-platform comprises bright colors and functional indicia to attract attention of said users and to induce learning in said user;

wherein said handgrip-top-surface of said generally-circular-handgrip comprising a lighted go-right-light, a lighted go-left-light and a lighted-stop-light;

wherein said lighted go-right-light and said lighted go-left-light are activated by maneuvering of said generally-circular-handgrip by said user, said lighted-stop-light activated when said generally-circular-handgrip is not being maneuvered by said user;

wherein said lighted go-right-light, said lighted go-left-light, and said lighted-stop-light, each are powered by batteries located in a plurality of cutouts on generally-circular-handgrip; and wherein said user is able to sit upon said generally-circular-rotating-seat-platform and use hands to grip said generally-circular-handgrip in a manner able to rotatably maneuver said generally-circular-rotating-seat-platform by rotating said generally-circular-handgrip in a left-direction and a right-direction as desired thus generating movement in a manner to provide entertainment for said user.

19. A method of using an around the world rotary toy system comprising the steps of:

placing generally-circular-stationary-base with attached bottom-section of vertical-cylindrical-support-post on planar surface for use;

placing generally-circular-rotating-seat-platform on rim of said bottom-section;

attaching top-section of said vertical-cylindrical-support-post to said bottom-section of vertical-cylindrical-support-post via attachment means;

sitting on said generally-circular-rotating-seat-platform;

rotating said generally-circular-rotating-seat-platform via using hands to maneuver generally-circular-handgrip as desired; and lowering said top-section into a volume of said bottom-section via releasing said attachment means for storage when not in use.

* * * * *